US007637820B2

(12) United States Patent
Zecevic

(10) Patent No.: US 7,637,820 B2
(45) Date of Patent: Dec. 29, 2009

(54) BALL SEPARATOR

(75) Inventor: Zoran Zecevic, Kirkbymoorside (GB)

(73) Assignee: Stepsahead Ltd., Scarborough, North Yorkshire (GB)

( * ) Notice: Subject to any disclaimer, the term of this patent is extended or adjusted under 35 U.S.C. 154(b) by 0 days.

(21) Appl. No.: 11/556,570

(22) Filed: Nov. 3, 2006

(65) Prior Publication Data

US 2007/0123361 A1 May 31, 2007

(30) Foreign Application Priority Data

Nov. 4, 2005 (GB) ..... 0522510.7

(51) Int. Cl.
*A63D 15/00* (2006.01)
*A63D 15/20* (2006.01)

(52) U.S. Cl. ..... 473/25; 473/1

(58) Field of Classification Search ..... 473/25, 473/24, 23, 22, 21, 1

See application file for complete search history.

(56) References Cited

U.S. PATENT DOCUMENTS 409,060 A * 8/1889 Paine ..... 473/25
451,536 A * 5/1891 Violett ..... 473/25
650,775 A * 5/1900 Berkstresser ..... 473/25
857,057 A * 6/1907 Haskell ..... 473/25
1,046,845 A * 12/1912 Olsen ..... 473/25
1,210,864 A * 1/1917 Sorensen et al. ..... 473/25
3,339,922 A 9/1967 Miller

FOREIGN PATENT DOCUMENTS

GB 1531252 A 11/1978
GB 2241651 A 9/1991
GB 2243556 A 11/1991
GB 2318301 A 4/1998

* cited by examiner

*Primary Examiner*—Mitra Aryanpour
(74) *Attorney, Agent, or Firm*—Kirton & McConkie; Evan R. Witt

(57) ABSTRACT

A ball separator for separating the balls of a first ball game from the balls of a second ball game. The ball separator includes a housing having an inlet for receiving the balls and in which a ball receiving part of the housing is movable between a first position in which at least one outlet is provided for dispensing balls under gravity to a first receptacle and a second position in which at least one outlet is provided for dispensing balls under gravity to a second receptacle. An actuator is provided to move the ball receiving part of the housing between the first and second positions.

10 Claims, 8 Drawing Sheets

BALL SEPARATOR

BACKGROUND OF THE INVENTION

This invention relates to ball games played on a ball game table with a cue, and in particular to a ball separator for separating the balls of a first ball game from the balls of a second ball game.

Ball games which can be played on a table with a cue, such as billiards or pool, are conventionally two player games. These ball games involve the use of one set of balls but differently marked. Snooker involves the use of a single set of balls and is usually played by two players. The set of balls used during a ball game cannot be altered so as to easily allow a third person to participate in the game.

Ball games such as billiards, pool or snooker are played on the playing surface of ball game tables. However, each type of ball game is required to be played on the playing surface of a different ball game table. The player is therefore unable to select the type of ball game which is to be played on the playing surface of a ball game table.

The present invention addresses these, and other, problems associated with conventional apparatus for ball games played with a cue.

BRIEF SUMMARY OF THE INVENTION

Accordingly, the present invention provides a ball separator for separating the balls of a first ball game from the balls of a second ball game, in which the ball separator comprises:

a housing having an inlet for receiving the balls in which a ball receiving part of the housing is pivotable between a first position in which at least one outlet is provided for dispensing balls under gravity to a first receptacle and a second position in which at least one outlet is provided for dispensing balls under gravity to a second receptacle; and an actuator for moving the ball receiving part of the housing between the first and second positions of the housing.

In a second aspect of the invention, there is provided an apparatus for playing at least a first and a second ball game comprising:

a playing surface on which the first and second ball games can be played; and a ball separator.

The present invention therefore has the advantage that the ball separator enables the balls of a first ball game and a second ball game to be separated from each other.

The set of balls of the first ball game can be played by a different number of players than the set of balls of the second ball game. The first ball game can contain a set of balls for a two player game. For example, the first ball game can contain a set of balls comprising two subsets of differently marked balls. The second ball game can contain a set of balls for a three player game. For example, the second ball game can contain a set of balls comprising three subsets of differently marked balls. The ball separator can therefore separate the balls of a three player game from the balls of a two player game. The player can therefore select the ball game to be played with a set of balls having the required number of subsets of differently marked balls according to the number of players playing the game.

The ball separator has the advantage that the player can select a first ball game having a first set of balls and a second ball game having a second set of balls. The first set of balls and the second set of balls can contain different sets of balls so that the first ball game can be played by a different number of players to the second ball game.

Preferably, at least one of the first and second ball games comprises a set of balls containing more than two subsets of differently marked balls.

The set of balls can comprise differently marked balls, for example the balls can be marked with stripes, checks, different colors or spots.

The first and second ball games can be selected from ball games played with a cue, such as for example pool, billiards and snooker. The present invention has the advantage that the ball separator enables the player to play more than one type of ball game played with a cue on the playing surface of a single ball game table. The ball separator can separate the balls of a first type of ball game from the balls of a second type of ball game. Preferably, the first ball game is a different type of ball game to the second ball game.

Preferably, the apparatus further comprises a game selection mechanism. The game selection mechanism can enable a player to select the type of ball game to be played by selecting the type of balls to be used during a game. The game selection mechanism can enable a player to choose between a first type of ball game and a second type of ball game. For example, the player can select a first ball game comprising a set of balls for billiards. The player can then select a second ball game comprising a set of balls for snooker.

The game selection mechanism can enable a player to select the sets of balls for a first and second ball game depending on the number of players. The game selection mechanism can therefore enable a player to select the balls for a first and second ball game depending on the number of subsets of differently marked balls required for the number of players. For example, a player can use the game selection mechanism to choose a first ball game comprising a set of balls containing two subsets of differently marked balls so that the first ball game can be played by two players. The player can then select a second ball game comprising a set of balls containing three subsets of differently marked balls so that the second ball game can be played by three players.

The game selection mechanism can enable a player to select the type of ball game to be played and the set of balls to be used depending on the number of players. For example, the player can use the game selection mechanism to choose a first ball game comprising a set of balls for billiards containing two subsets of differently marked balls so that the first ball game can be played by two players. The player can then use the game selection mechanism to choose a second ball game comprising a set of balls for pool containing three subsets of differently marked balls so that the second ball game can be played by three players.

The housing can include an open upper surface which provides the inlet for receiving the balls. The housing can be composed of metal, for example stainless steel, or plastic. Preferably, the housing comprises a base. The base preferably comprises a first end and a second end. The first and second ends preferably form a pair of opposed ends of the base. The housing preferably comprises at least one perimeter wall extending upwardly relative to the base. The at least one perimeter wall and the base can provide a cavity for receiving the balls. The base can be tilted relative to the perimeter wall.

Preferably, at least a portion of the base of the housing is tilted relative to the horizontal plane of the playing surface provided by the ball game table when the ball receiving part of the housing is in the first and second positions. The angle formed by the base when the ball receiving part of the housing is in either the first and second positions is preferably such that at least a portion of the base is neither parallel to nor perpendicular to the playing surface provided by the ball game table. The base is preferably tilted sufficiently to enable the balls to be dispensed from the housing through the at least one outlet under the effect of gravity.

When the ball receiving part of the housing is in the first position, the base is preferably tilted so that the second end of the base is lower relative to the first end of the base. Preferably, the second end of the base is sufficiently lower relative to the first end of the base to enable balls to be dispensed through an outlet into a first receptacle under the effect of gravity. Furthermore, when the ball receiving part of the housing is in the second position the first end of the base can be lower relative to the second end of the base. Preferably, the first end of the base is sufficiently lower relative to the second end of the base to enable balls to be dispensed through an outlet into a second receptacle under the effect of gravity.

A first outlet is preferably provided adjacent to the first end of the base. A second outlet is preferably provided adjacent to the second end of the base. A first outlet is preferably provided by a perimeter wall extending upwardly relative to the first end of the base. A second outlet is preferably also provided by a perimeter wall extending upwardly from the second end of the base. When the ball receiving part of the housing is in the first position the balls are preferably dispensed out of the second outlet. When the ball receiving part of the housing is in the second position the balls are preferably dispensed out of the first outlet. Preferably the first and second outlets are aligned along a line joining the first and second ends of the base.

Preferably, the perimeter wall is static and the base can be tilted relative to the perimeter wall of the housing. The base can be tilted relative to the horizontal plane of the playing surface provided by the ball game table to raise a first end of the base and lower a second end of the base relative to the perimeter wall. In the first or second position, the base is tilted sufficiently about the horizontal axis so that one end of the base is lower than the perimeter wall. An opening is provided between the lower end of the base and the perimeter wall. The opening is sufficient in size to provide the outlet for dispensing balls. Preferably, the opening provided between the perimeter wall and the lower end of the base is in communication with a channel for dispensing the balls into the first or second receptacles.

When the ball receiving part of the housing is in either the first or second positions, at least a portion of the base is preferably tilted by an acute angle (i.e. an angle of less than 90°) relative to the horizontal plane of the playing surface of the ball game table. The base is preferably tilted relative to the horizontal plane of the playing surface provided by the ball game table by an angle greater than about 0.5°, more preferably greater than about 10°, for example about 20°. The angle is preferably less than about 75°, more preferably less than about 45°, for example about 30°. For example, the angle is in the range of about 0.5° to about 75°, preferably the angle is in the range of about 10° to about 45°, more preferably the angle is in the range of about 20° to about 30° relative to the horizontal plane of the playing surface provided by the ball game table.

The ball separator can be tilted by a manually operable tilting mechanism. The manually operating tilting mechanism can comprise at least one connecting rod for tilting the ball receiving part of the housing between a first or second position.

The ball separator can be tilted by an electronic mechanism. The electronic mechanism can comprise an electrical motor for tilting the ball receiving part of the housing between a first or second position.

The actuator can pivot the ball receiving part of the housing about a substantially horizontal axis so as to move the ball receiving part of the housing between the first and second positions. Preferably, the horizontal axis is substantially parallel to the playing surface provided by the ball game table. Preferably, the horizontal axis is perpendicular to the direction of gravity.

The horizontal axis is preferably neither parallel nor perpendicular to a line joining the first end and second end of the base. The horizontal axis preferably extends at an acute angle of greater than about 5°, preferably greater than about 15°, for example about 30° relative to a line joining the first and second ends of the base. The horizontal axis preferably extends at an acute angle of less than about 75°, more preferably less than about 60°, for example less than about 45° relative to a line joining the first and second ends of the base.

The actuator preferably comprises a pivotable member attached to the housing. The pivotable member can be attached to the base of the housing. The pivotable member can be an elongate member. The pivotable member can be rotated by the actuator about the substantially horizontal axis which is substantially parallel to the playing surface provided by the ball game table.

The actuator preferably comprises at least one connecting rod. The connecting rod can be displaced upwardly to contact an end of the base. The connecting rod causes the base to pivot about the pivotable member and moves the ball receiving part of the housing between the first and second positions.

The at least one connecting rod can preferably be displaced upwardly relative to the playing surface of the ball game table. The at least one connecting rod is preferably aligned so as to engage a region toward an end of the base. The at least one connecting rod is preferably moveable between a first position in which the at least one connecting rod contacts the base and a second position in which the at least one connecting rod is disengaged from the base. The at least one connecting rod preferably comprises a first end and a second end. The at least one connecting rod is preferably substantially aligned with the direction of gravity. Preferably, the at least one connecting rod is substantially perpendicular to a plane parallel to the playing surface provided by the ball game table.

Preferably, a first connecting rod is arranged so that the first end of the connecting rod can be displaced to contact the housing toward the first end of the base. The actuator can comprise a second connecting rod arranged so that the second end of the connecting rod can be displaced to contact the housing toward the second end of the base.

The actuator preferably comprises a wedge in communication with the game selection mechanism. Preferably, the wedge is in communication with a coin operated mechanism.

Preferably, the actuator comprises first and second wedges in communication with the game selection mechanism, for example the coin operated mechanism. The actuator can comprise a first wedge in communication with a first game selection mechanism and a second wedge in communication with a second game selection mechanism. The first and second game selection mechanisms can be located at opposite ends of the housing. Preferably, the first and second game selection mechanisms are located at diagonally opposite corners of the housing.

Preferably, the wedge is arranged so that the upper surface of the wedge extends at an angle to the playing surface of the ball game table. The lower surface is preferably substantially parallel to the playing surface of the ball game table.

The wedge is preferably arranged to engage the second end of a connecting rod. Preferably, the second end of the connecting rod engages the upper surface of the wedge.

Preferably, the second end of the connecting rod is attached to a runner, such as for example a rotatable member or a slider.

The rotatable member can be a roller or a wheel. The runner is preferably contacted with the upper surface of the wedge.

In use, the wedge can be displaced causing the connecting rod to be moved along the upper surface of the wedge. Preferably, the runner is moved along the upper surface of the wedge. The first end of the connecting rod is preferably raised upwardly relative to the playing surface provided by the ball game table to engage an end of the base. The connecting rod tilts the base relative to the horizontal plane of the playing surface provided by the ball game table. The connecting rod therefore moves the ball receiving part of the housing to the first or second position in which balls can be dispensed under gravity into a first or second receptacle.

The wedge can then be returned in the opposite direction. Preferably, the actuator further comprises a return mechanism which applies a return force to the wedge. As the wedge is returned the connecting rod is displaced in the opposite direction along the upper surface of the wedge. Preferably, the runner is displaced in the opposite direction along the upper surface of the wedge.

The first end of the connecting rod lowers relative to the playing surface of the ball game table. The end of the base in contact with the first end of the connecting rod lowers relative to the playing surface of the ball game table. Preferably, the first end of the connecting rod lowers sufficiently so as to be disengaged from the base of the housing.

Preferably, the base of the housing is arranged so as to be aligned in a horizontal plane substantially parallel to the playing surface of the ball game table when the connecting rod is disengaged from the base of the housing.

The housing can further comprise at least one alignment member to maintain the base in position when the connecting rod is disengaged from the housing. Preferably, the base is maintained in a horizontal plane parallel to the playing surface of the ball game table when disengaged from the connecting rod.

A first alignment member is preferably provided on a surface of the housing and a second alignment member is provided on an opposed surface of the base to cooperatively engage the first alignment member. Preferably, the alignment members are magnetic.

Preferably, in use the connecting member is displaced upwardly and engages the end of the base with sufficient force to overcome the engagement or attraction between the alignment members provided by the housing and therefore enables the base of the housing to be tilted relative to a plane substantially parallel to the playing surface provided by the ball game table.

The housing can be arranged so that the ball receiving part of the housing is in the first position when the at least one connecting member is disengaged from the base. For example, the base is tilted relative to the horizontal plane of the playing surface provided by the ball game table. In use, the at least one connecting rod can be displaced vertically to contact the lower end of the base. The lower end of the base is preferably raised by the connecting rod causing the base to pivot about the pivotable member. The opposite end of the base lowers and the ball receiving part of the housing is moved to the second position. When the at least one connecting rod is disengaged from the base, the ball receiving part of the housing automatically returns to the first position.

When the housing is rotated about a substantially horizontal axis, the actuator preferably comprises a tilt mechanism connected to the driver. The tilt mechanism is preferably connected to the housing. The tilt mechanism can be directly mounted on the housing. The tilt mechanism can be mounted on the base of the housing.

The tilt mechanism can be operated by the driver to rotate the pivotable member about a substantially horizontal axis parallel to the plane provided by the playing surface of the ball game table so that the housing is in the first position or in the second position. For example, the tilt mechanism can comprise a threaded bore and a threaded screw received within the threaded bore. The threaded bore can be located at least one of the first or second end of the base of the housing. The threaded screw can extend from a fixed position below the base of the housing so that the threaded shaft of the screw is received within and interengages with the threaded bore.

The driver can cause rotation of the threaded screw relative to the threaded bore. Rotation in a first direction of the screw at a first end of the base of the housing causes the threaded shaft of the screw to extend further into the bore. Rotation of the screw therefore subjects the first end of the base to a downward force and causes the pivotable member to rotate about the substantially horizontal axis so that the first end of the base is lowered relative to the second end of the base. Rotation in a second direction which can be in an opposite direction to the first direction of the screw causes the threaded shaft of the screw to withdraw from the threaded bore.

The housing can be adapted so that rotation of the screw in the reverse direction subjects the first end of the base to an upward force and therefore the first end of the base is raised relative to the second end of the base. For example, the housing can be balanced across the pivotable member such that on withdrawing the screw from the threaded bore the weight of the housing causes the second end of the base to lower relative to the first end of the base.

The housing can further comprise at least one stiffening member extending between opposed surfaces of the housing. The at least one stiffening member maintains the rigidity of the housing. Preferably, the housing comprises a plurality of stiffening members which are mutually spaced along the housing.

When the ball receiving part of the housing is in the first and second positions the second end of the base is preferably lower relative to the first end of the base. Preferably, the second end of the base is sufficiently lower than the first end of the base to enable the balls to be dispensed from the housing under the effect of gravity. The at least one outlet is preferably provided by a sidewall extending upwardly from the second end of the base.

The actuator can rotate the ball receiving part of the housing about a substantially vertical axis between the first and second positions of the ball receiving part of the housing. When the ball receiving part of the housing is in the first position the balls can be dispensed into a first receptacle. When the ball receiving part of the housing is in the second position the balls can be dispensed into a second receptacle. Preferably, the first and second receptacles are different receptacles.

The vertical axis is preferably substantially aligned with the direction of gravity. Preferably, the vertical axis is substantially perpendicular to a plane parallel to the playing surface provided by the ball game table.

The ball separator can be rotated about a substantially vertical axis by a manually operable rotation mechanism. The manually operating rotation mechanism can comprise at least one connecting rod for rotating the ball separator so that the housing is in the first or second position.

The ball separator can be rotated by an electronic rotation mechanism. The electronic rotation mechanism can comprise an electrical motor for rotating the ball separator so that the housing is in the first or second position.

The actuator can comprise a rotatable member which is attached to the housing. The rotatable member is preferably substantially aligned with a vertical axis. The rotatable member is preferably attached to and extends downwardly from the base of the housing. The rotatable member and the ball receiving part of the housing can be rotated about a substantially vertical axis by a driver.

The actuator preferably further comprises a driver to rotate the ball receiving part of the housing between the first and second positions. The driver can rotate the rotatable member about a substantially vertical axis which is perpendicular to the horizontal plane provided by the playing surface of the ball game table.

The free end of the rotatable member which is attached to the housing is received within the rotation mechanism. The free end of the rotatable member interengages with the rotation mechanism. The free end of the rotatable member can provide a threaded portion or at least one notch which engages with a corresponding threaded portion or at least one protrusion provided by the rotation mechanism. The driver causes the rotation mechanism to rotate about a substantially vertical axis, ie. an axis which is substantially perpendicular to the playing surface provided by the ball game table. The rotation mechanism engages the rotatable member and therefore causes the housing to rotate about a substantially vertical position between the first and second positions.

The actuator can also comprise a travel detector for detecting when the ball receiving part of the housing has been rotated sufficiently to reach the first or second positions. When the travel detector has detected that the ball receiving part of the housing has been rotated sufficiently about the substantially vertical axis in one direction to be in either the first or second positions no further rotation in that direction is provided by the actuator.

The housing can include at least one guide surface extending from the inlet towards the base. Preferably, the inlet is provided by an open upper surface of the housing. The at least one guide surface can be composed of metal, for example stainless steel, or plastic. The guide surface can direct the balls towards the outlet. The guide surface can be provided by a surface which is separate from the housing. Alternatively, the guide surface can be provided by the internal surfaces of the housing. For example, at least a portion of at least one perimeter wall of the housing is tapered towards the outlet. The internal surface of the at least one perimeter wall acts as a guide surface and directs balls towards the outlet.

The ball separator can further include a mounting platform for securing the ball separator to the apparatus, eg. a ball game table. The ball receiving part of the housing is preferably rotatable relative to the mounting platform. The mounting platform can be secured to the base of a ball game table.

In a further aspect, the present invention provides a method of providing an apparatus for playing at least a first ball game and a second ball game. The method comprises providing a ball game separator as part of the ball game table. The ball separator can be retrofitted to the ball game table. The ball separator can be installed into pre-existing billiards, pool or snooker tables. Alternatively, the ball separator is provided during initial manufacture of the ball game table.

The ball separator is fitted within a ball game table having a plurality of pockets for receiving balls. The player selects the type of game and/or the number of players playing the ball game. The balls are transmitted from the pockets to the ball separator during use. Channels extend from the pockets towards the ball separator. The channels are adapted to receive the balls. The channels extend towards the inlet provided by the ball separator. The balls are preferably guided from the inlet to the outlet by a guide surface. The ball separator is arranged so that the ball receiving part of the housing is in the first or second position so that the balls are dispensed under gravity into the desired receptacle. Preferably, the ball game table is arranged so that when the ball receiving part of the housing is in the first position balls are dispensed into a first receptacle. Preferably, the ball table is arranged so that when the ball receiving part of the housing is in the second position balls are dispensed into a second receptacle. Preferably, the first and second receptacles are located at opposite ends of the ball game table.

BRIEF DESCRIPTION OF THE DRAWINGS

Embodiments of the present invention will now be described, by way of example only, and with reference to the accompanying drawings, in which.

DETAILED DESCRIPTION OF THE INVENTION

Figure 1:
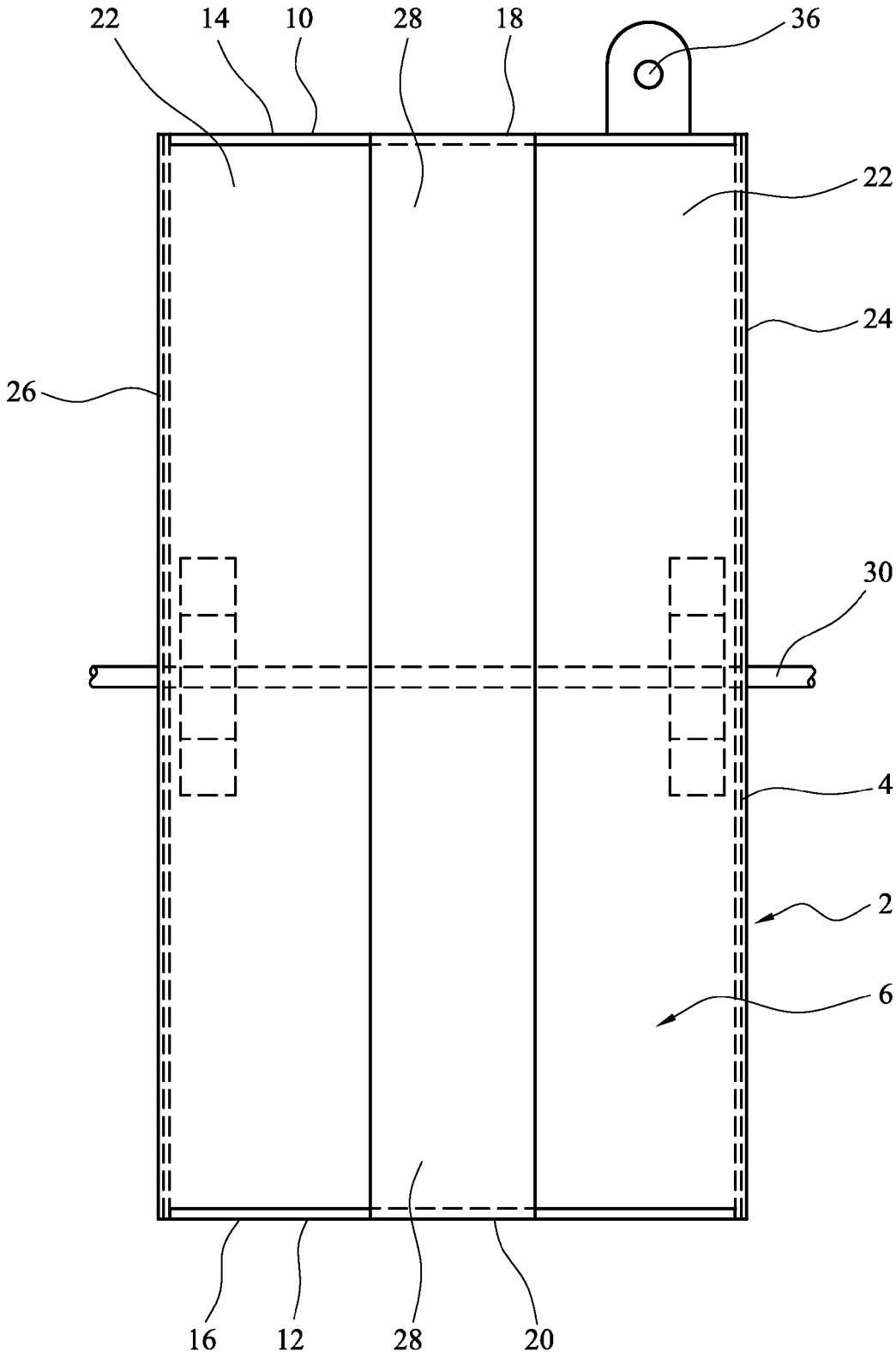
FIG. 1 shows a view from above of a ball separator according to one embodiment of the present invention.
Figure 2:
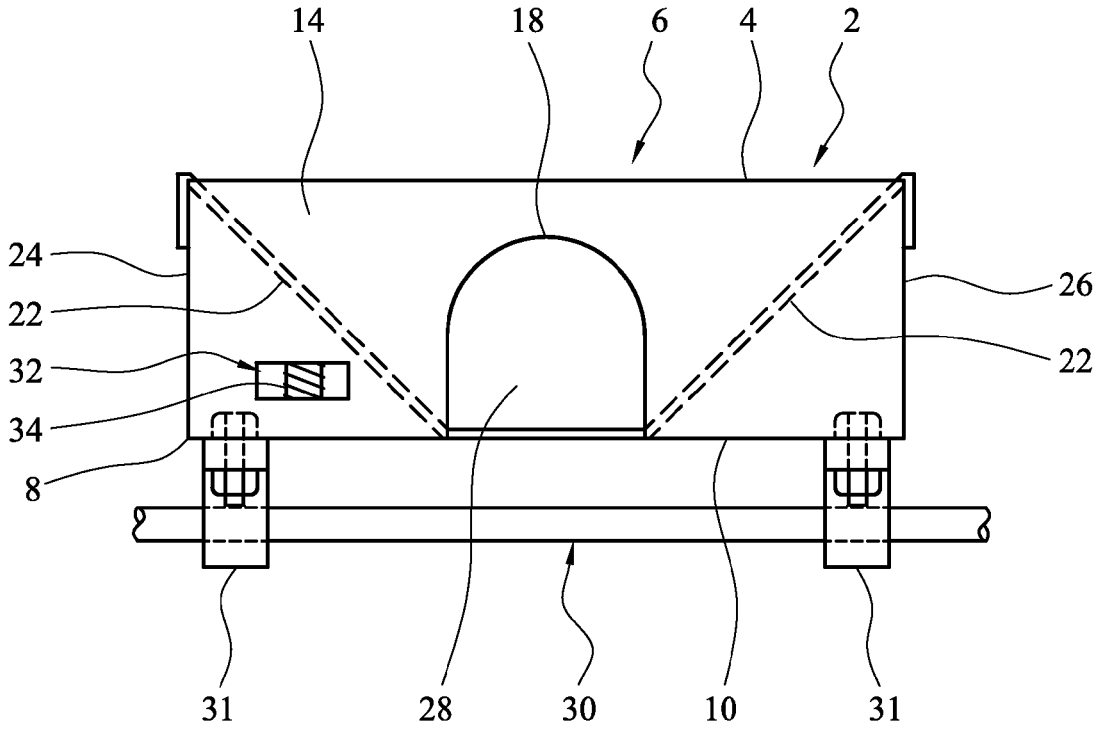
FIG. 2 shows a side view of the ball separator shown in FIG. 1.
Figure 3:
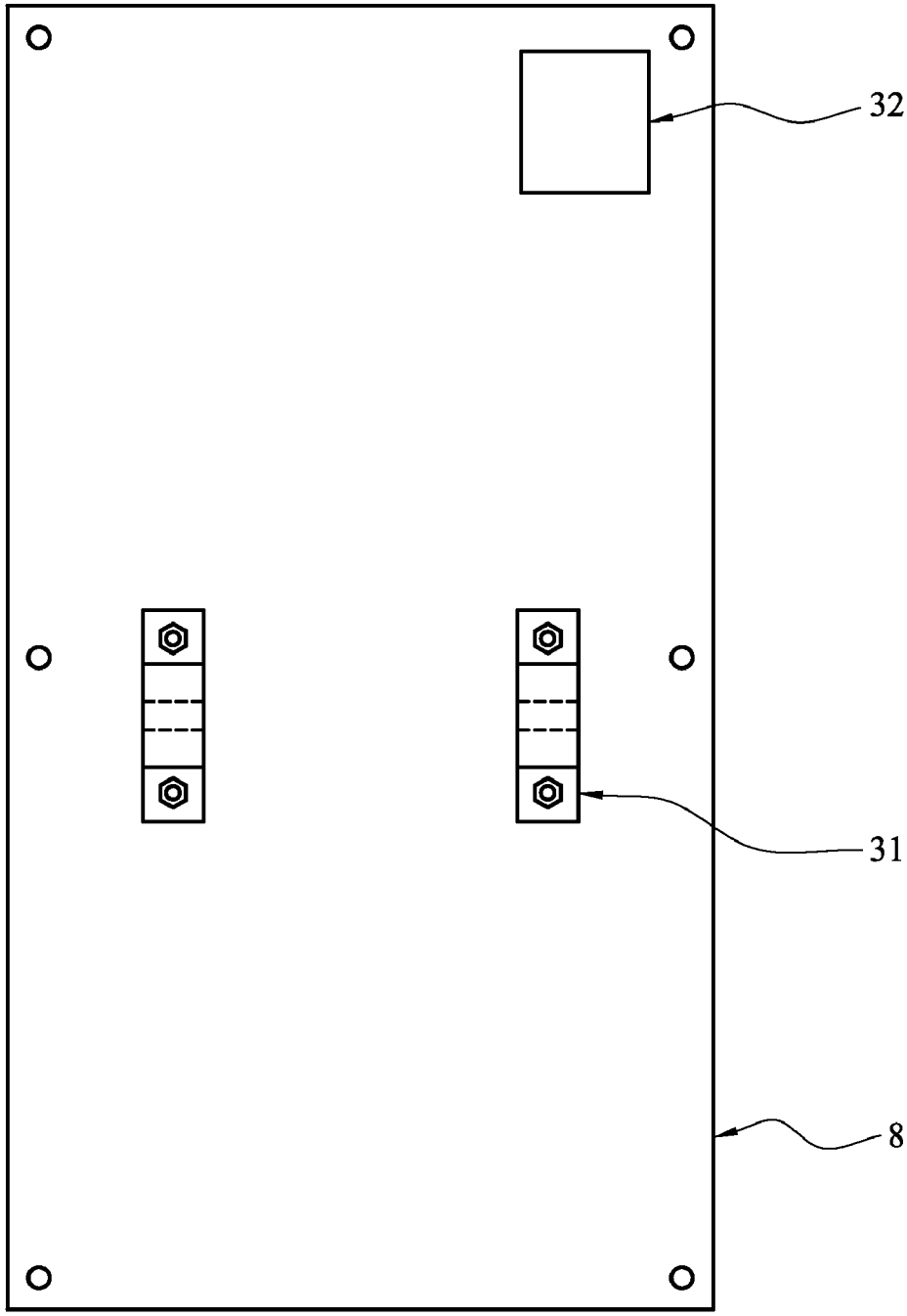
FIG. 3 shows a view from below the housing of the ball separator shown in FIG. 1.

With reference to FIGS. 1 to 3, the ball separator 2 comprises a housing 4 in the shape of a rectangular box. The housing 4 is composed of stainless steel. The open upper surface of the housing 4 provides an inlet 6 which is adapted to receive balls. The housing 4 comprises a base 8 having a first end 10 and a second end 12. The first end 10 and second end 12 form a pair of opposed ends. A first perimeter wall 14 extends upwardly from and substantially perpendicular to the first end 10 of the base. A second perimeter wall 16 extends upwardly from and substantially perpendicular to the second end 12 of the base. The first perimeter wall 14 and second perimeter wall 16 extend substantially parallel to each other. The first perimeter wall 14 provides a first outlet 18 for dispensing the balls under the effect of gravity. The second perimeter wall 16 provides a second outlet 20 for dispensing the balls under the effect of gravity. The first 18 and second 20 outlets are arch shaped. The first 18 and second 20 outlets are arranged so as to be aligned along a line joining the first 10 and second 12 ends of the base 8.

The housing 4 further includes two guide surfaces 22. The guide surfaces 22 extend along perimeter walls 24 and 26 of the housing which extend between the first 14 and second 16 perimeter walls. The guide surfaces 22 extend downwardly from the inlet 6 provided by the open upper surface of the housing 4 towards the base 8. The guide surfaces 16 provide a channel 28 which extends between the first 18 and second 20 outlets.

The housing 4 is secured to a pivotable member 30 by fixings 31. The pivotable member 30 is attached to the base 8 of the housing 4. The pivotable member 30 extends substantially perpendicular to a line joining the first end 10 and second end 12 of the base 8. The pivotable member 30 comprises an elongate member. The longitudinal axis of the elongate member extends in a plane substantially parallel to the plane provided by the base 8 of the housing 4 and perpendicular to a line joining the first 10 and second 12 ends of the base 8.

A tilt mechanism 32 is attached to the housing 4. The tilt mechanism 32 comprises a threaded bore 34 which extends upwardly from and substantially perpendicular to the first end 10 of the base 8 of the housing 4. The shaft of a threaded screw 36 is received within and interengages with the threaded bore 34. The threaded screw 36 is secured in a fixed position relative to the housing 4. A driver (not shown) is connected to the tilt mechanism 32.

Figure 4:
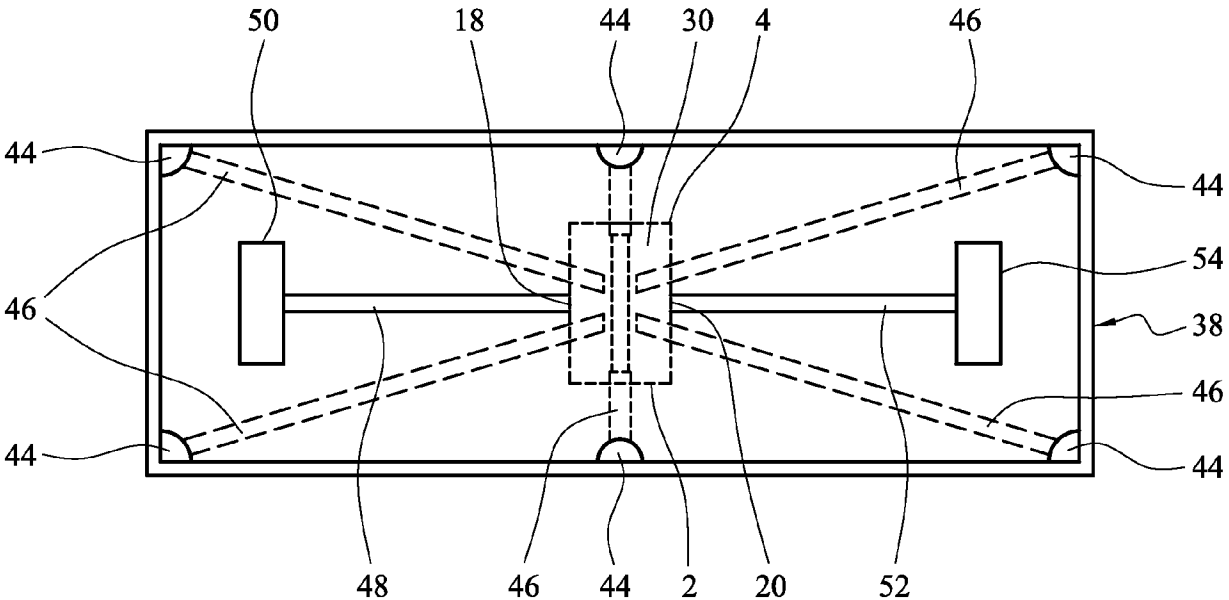
FIG. 4 shows a view from above of a ball game table provided with a ball separator according to the present invention.
Figure 5:
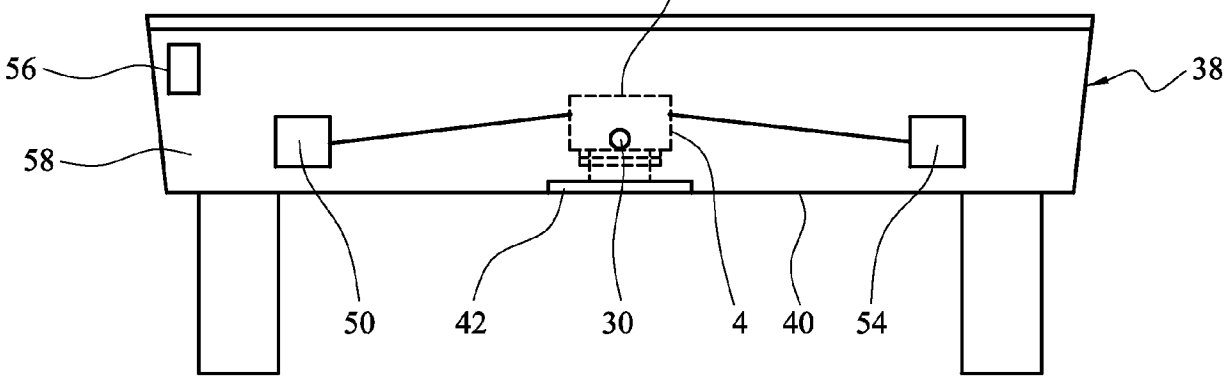
FIG. 5 shows a side view of the ball game table shown in FIG. 4.

With reference to FIGS. 4 and 5 the ball separator 2 has been installed within a ball game table 38. The ball separator 2 can be fitted to a pre-existing ball game table 38 by installing the ball separator 2 within the ball game table 38. The ball separator 2 can be provided within a ball game table 38 during the initial manufacture of the ball game table 38. The ball separator 2 is secured to the base 40 of a ball game table 38 by a mounting platform 42.

The ball game table 38 has six pockets 44 for receiving balls. The pockets 44 are each connected to a channel 46. The channels 46 extend from a pocket 44 to the inlet 6 of the ball separator 2. The first outlet 18 is connected to a first outlet channel 48 which is connected to a first receptacle 50. The second outlet 20 is connected to an second outlet channel 52 which is connected to a second receptacle 54. The first 50 and second 54 receptacles are located at opposite ends of the ball game table 38. The first receptacle 50 is adjacent to the first outlet 18. The second receptacle 54 is adjacent to the second outlet 20. The ball game table 38 comprises a game selection mechanism 56 positioned on the outer side surface 58 of the ball game table 38.

In use, the user uses the game selection mechanism 56 to select the first ball game. The player can select the type of ball game and/or the set of balls depending on the number of players playing the game. The game selection mechanism 56 causes an electric motor (not shown) to rotate the threaded screw 36 relative to the threaded bore 34. The rotation of the threaded screw 36 in the first direction causes the shaft of the screw to progress further along the threaded bore 34 of the tilt mechanism 32. The rotation of the screw 36 therefore subjects the first end 10 of the base 8 to a downward force and causes the first end 10 of the base 8 to be lowered and the pivotable member 30 to rotate about its longitudinal axis. The first end 10 of the base 8 is therefore lowered relative to the second end 12 of the base 8.

During the ball game the balls are received by the pockets 44. The balls travel along the channels 46 and enter the ball separator 2 through the inlet 6. The guide surfaces 22 direct the balls towards the base 8. The housing 4 is tilted so that the first end 10 of the base 8 is lower than the second end 12 of the base 8. The housing 4 is therefore sufficiently tilted so that the balls are dispensed out of the first outlet 18 under the effect of gravity along the first outlet channel 48 into the first receptacle 48.

The player then selects the second ball game. The player can select the type of ball game and/or the set of balls depending on the number of players playing the game.

The game selection mechanism 56 causes an electric motor (not shown) to rotate the threaded screw 36 relative to the threaded bore 34 in a second direction (opposed to the first direction). The rotation of the threaded screw 36 in the second direction causes the shaft of the screw 36 to be withdrawn from the threaded bore 34 of the tilt mechanism 32. The housing 4 is adapted so that the rotation of the screw 36 in the second direction subjects the first end 10 of the base 8 to an upward force and causes the first end 10 of the base 8 to be raised relative to the second end 12 of the base 8 and the pivotable member 30 to rotate about its longitudinal axis.

During the ball game the balls are received by the pockets 44. The balls travel along the channels 46 and enter the ball separator 2 through the inlet 6. Guide surfaces 22 direct the balls towards the outlet 20. The housing 4 is tilted so that the second end 12 of the base 8 is lower than the first end 10 of the base 8. The housing 4 is therefore sufficiently tilted so that the balls are dispensed out of the second outlet 20 under the effect of gravity along the second outlet channel 52 into the second receptacle 54.

Figure 6:
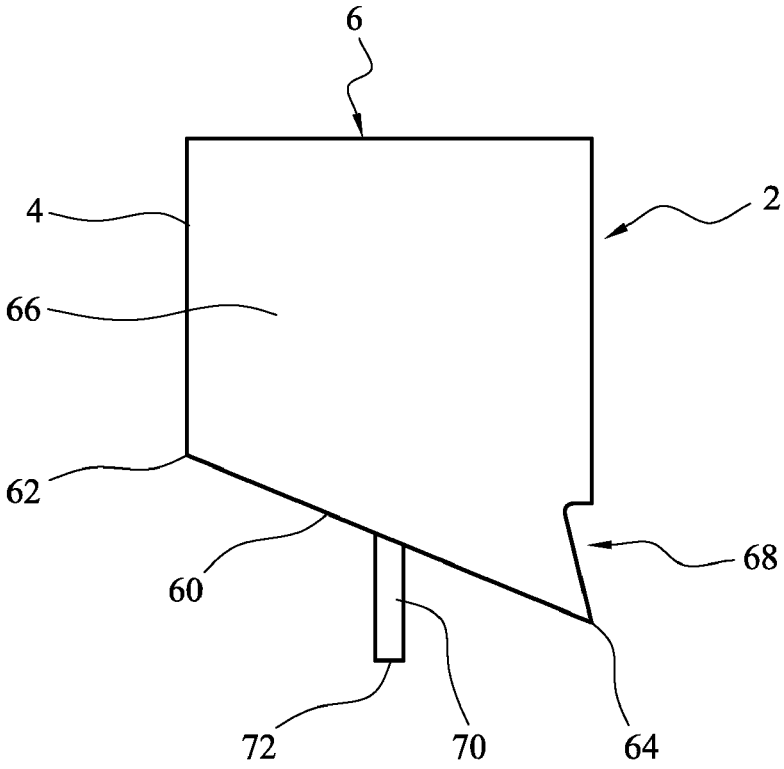
FIG. 6 shows a side view of a ball separator according to a further embodiment of the present invention.
Figure 7:
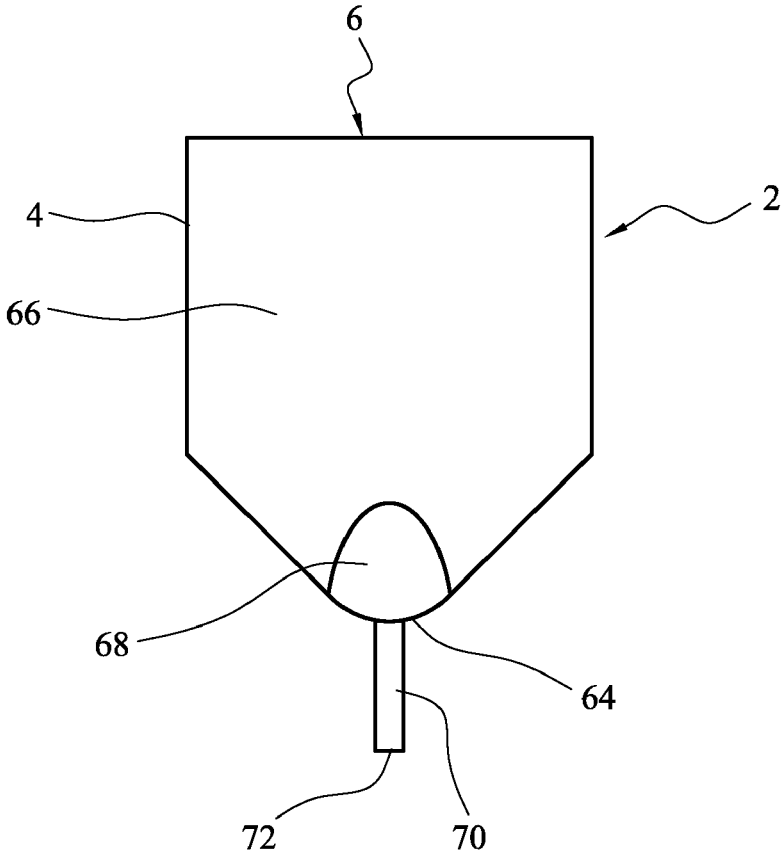
FIG. 7 shows a front view of a ball separator shown in FIG. 6.

With reference to FIGS. 6 and 7 a ball separator 2 according to a further embodiment of the present invention comprises a housing 4. The housing 4 is composed of stainless steel. The housing 4 has a circular cross-section. The housing 4 has an open upper surface which provides an inlet 6 for receiving balls. The housing 4 comprises a base 60 having a first end 62 and a second end 64. The first 62 and second 64 ends are directly opposite to each other. The base 60 is sloped so that the second end 64 of the base 60 is lower than the first end 62. A side wall 66 extends upwardly from the base 60. A guide surface is provided by the inner surface of the side wall 66. The side portion 66 tapers inwardly towards the base 60.

The side wall 66 adjacent to the second end 64 of the base 60 provides an outlet 68 so that balls can be dispensed through the outlet 68 under the effect of gravity.

A rotatable member 70 is attached to the base 60 of the housing 4. The rotatable member 70 extends substantially vertically from the base 60, i.e. substantially aligned with gravity.

The free end 72 of the rotatable member 70 is screw threaded. A rotation mechanism (not shown) interengages with the screw thread of the free end 72 of the rotatable member 70.

In use, the ball separator 2 is installed within a ball game table 38. The ball separator 2 can be installed within a pre-existing ball game table 38. The ball separator 2 can be introduced to the ball game table 38 during initial manufacture of the ball game table 38. The ball game table 38 has a game selection mechanism (not shown). The player can use the game selection mechanism to select the set of balls for the game to be played.

An electric motor (not shown) causes the rotation mechanism (not shown) to rotate. As the rotation mechanism (not shown) is engaged with the free end 72 of the rotatable member 70 the rotation of the rotation mechanism causes the rotatable member 70 to rotate. The rotatable member 70 rotates about a substantially vertical axis until the housing 4 is in a first position. In the first position the second end 64 of the base 60 is lower than the first end 62 of the base 60.

The ball game table 38 has six pockets 44 for receiving balls. The pockets 44 are each connected to a channel 46. The channels 46 extend from a pocket 44 to the inlet 6 of the ball separator 2. The inner surface of the side wall 66 is tapered and therefore directs the balls towards the outlet 68. In the first position the outlet 68 is connected to a first outlet channel 48 which is connected to a first receptacle 50. When the housing 4 is in the first position the balls are dispensed under the effects of gravity out of outlet 68 into the first receptacle 50.

The player can then select a second ball game. The electric motor (not shown) causes the rotation mechanism (not shown) to rotate. As the rotation mechanism (not shown) is engaged with the free end 72 of the rotatable member 70 the rotation of the rotation mechanism causes the rotatable member 70 to rotate. The rotatable member 70 rotates about a substantially vertical axis until the housing 4 is in a second position. In the second position the second end 64 of the base 60 is lower than the first end 62 of the base 60.

In the second position the outlet 68 is connected to a second outlet channel 52 which is connected to a second receptacle 54. The balls are therefore dispensed under the effects of gravity out of outlet 68 into the second receptacle 54.

Figure 8:
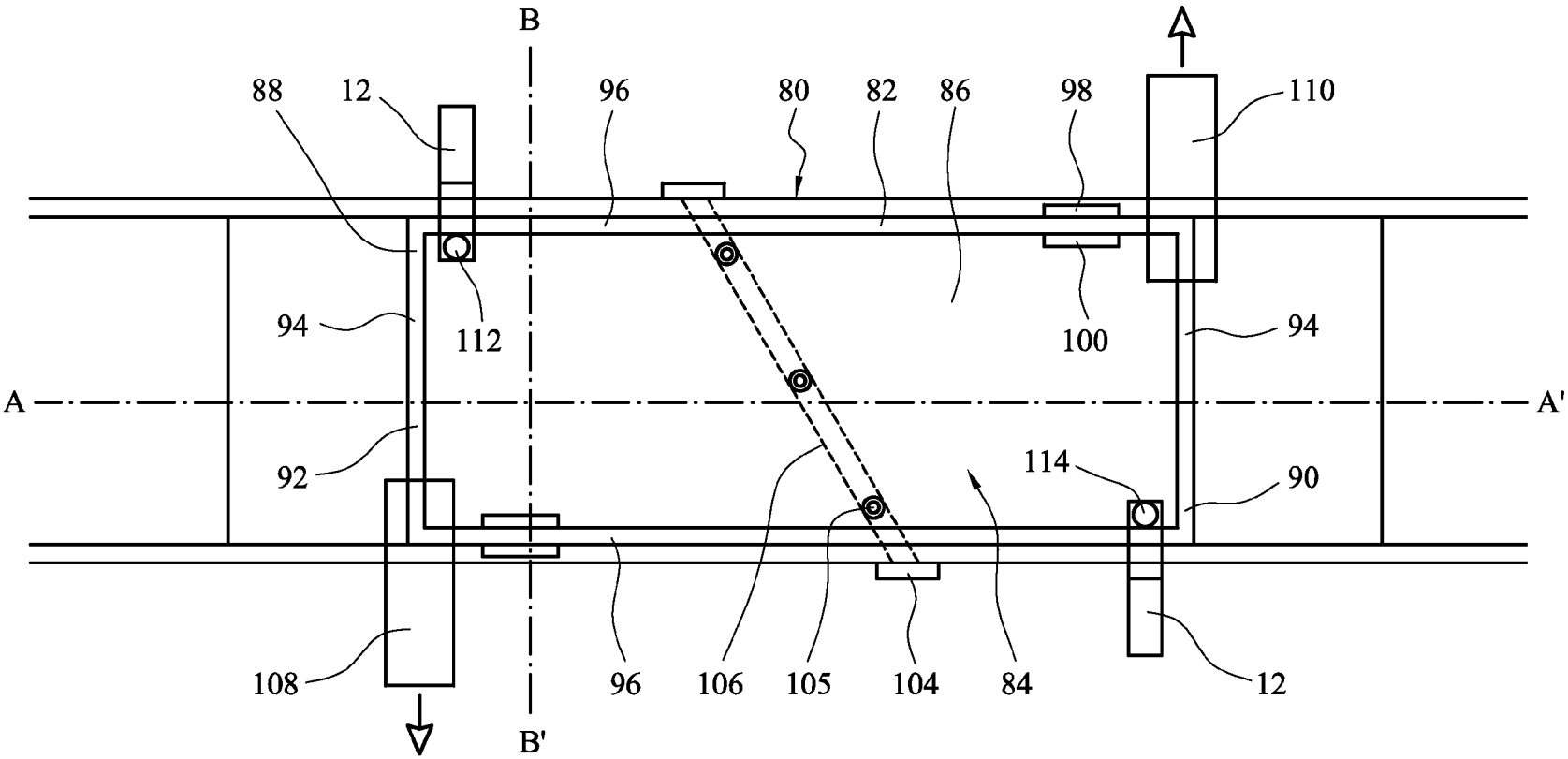
FIG. 8 shows a view from above of a ball separator according to a further embodiment of the present invention.
Figure 9:
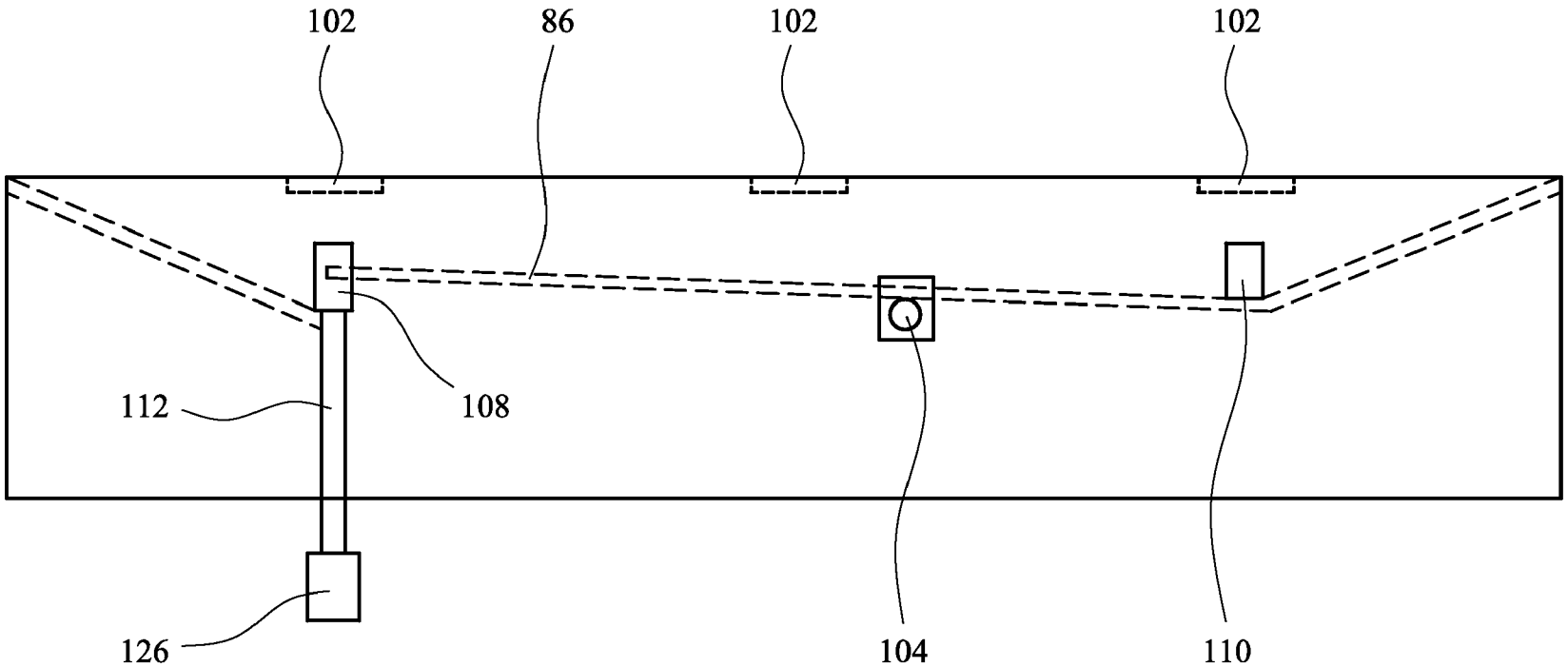
FIG. 9 shows a cross-sectional view of a ball separator shown in FIG. 8 along the line A-A'.
Figure 10:
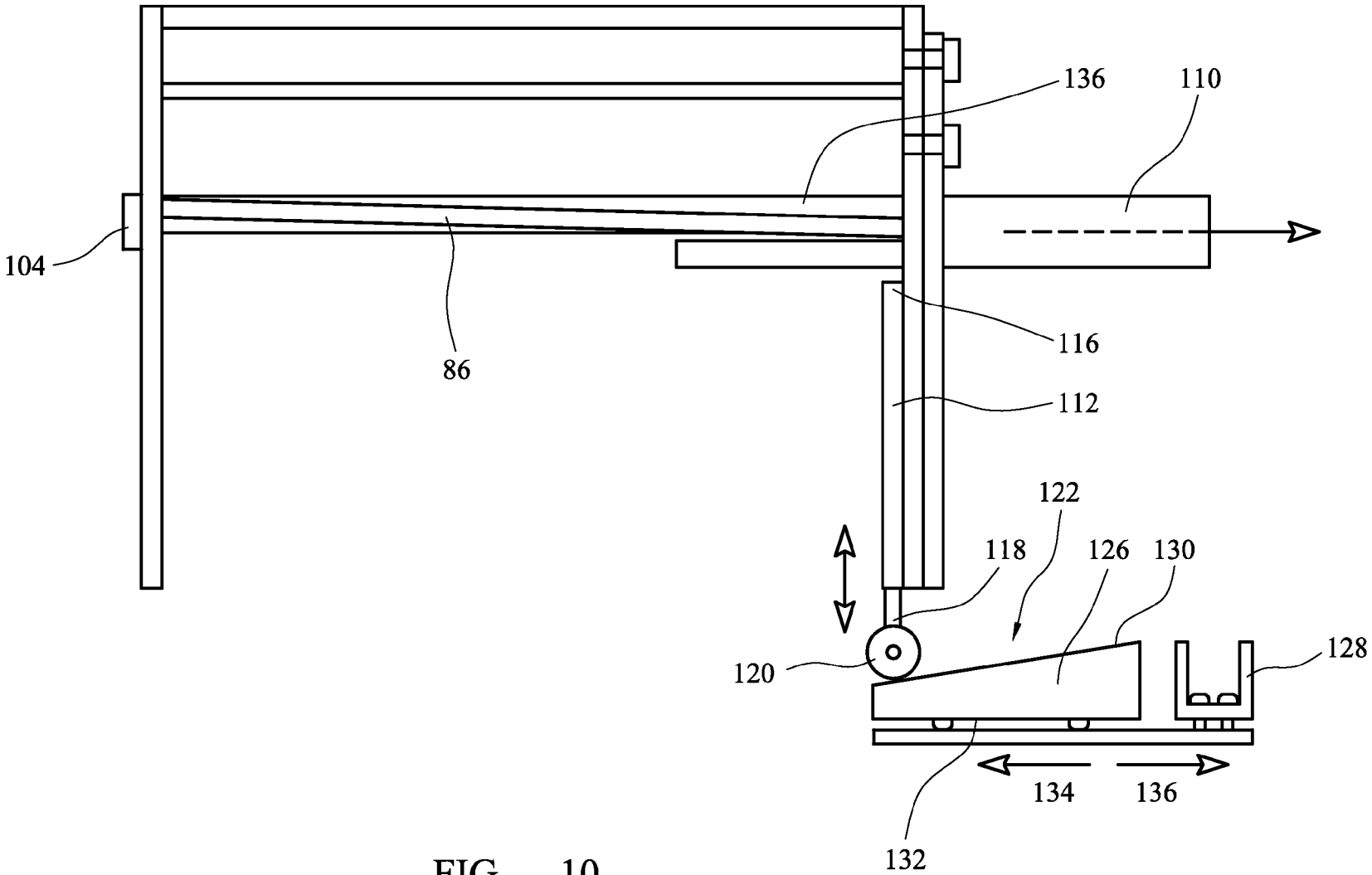
FIG. 10 shows a cross-sectional view of a ball separator shown in FIG. 8 along the line B-B'.

With reference to FIGS. 8 to 10 a ball separator 80 according to a further embodiment of the present invention comprises a rectangular housing 82. The open upper face of the housing 82 provides an inlet 84 which is adapted to receive balls. The housing 82 comprises a base 86 having a first end 88 and a second end 90. The first end 88 and second end 90 form a pair of opposed ends.

The housing 82 includes a perimeter wall 92 which extends upwardly relative to the base 86. The perimeter wall 92 includes a first pair of opposed walls 94 extending upwardly from the first end 88 and second end 90 of the base 86. The perimeter wall 92 also includes a second pair of opposed walls 96 extending between the first pair of opposed walls 94. The base 86 is pivotable relative to the static perimeter wall 92 of the housing 82.

The perimeter wall 92 and the base 86 define a cavity for receiving balls. The perimeter wall 92 includes a first magnetic member 98 which cooperatively engages a second magnetic member 100 on an opposed surface of the base 86. The attraction between the first 98 and second 100 magnetic members holds the base 86 in a substantially horizontal position, which is substantially perpendicular to the direction of gravity. The base 86 is held in position by the attraction between the magnetic members 98 and 100 so that the base 86 extends substantially parallel to the playing surface provided by the ball game table when level.

Three mutually spaced support members 102 extend across the open upper surface of the housing 82 between the second pair of opposed walls 96 of the perimeter wall 92. The support members 102 extend substantially perpendicular to a line extending between the first 88 and second 90 ends of the base 86.

The base 86 of the housing 82 is secured to a pivotable member 104 by fixings 105. The pivotable member 104 extends generally diagonally across the base 86. The pivotable member extends at an acute angle to a line joining the first end 88 and the second end 90 of the base 86, or is not perpendicular to the side walls of the housing. The pivotable member 104 comprises an elongate member 106.

A first channel 108 for receiving the balls from the housing 82 is positioned below the perimeter wall 92 at the first end 88 of the base 86 and is arranged to receive balls dispensed under gravity from the first end 88 of the base 86. A second channel 110 for receiving the balls from the housing 82 is positioned below the perimeter wall 92 and the second end 90 of the base 86 and is arranged to receive balls dispensed under gravity from the second end 90 of the base 86. The first 108 and second 110 channels are positioned adjacent to diagonally opposite corners of the base 86.

The ball separator 80 includes an actuator comprising a first connector rod 112 and a second connector rod 114. The first connector rod 112 is positioned adjacent to one of the corners of the first end 88 of the base 86. The second connector rod 114 is positioned adjacent to the diagonally opposite corner at the second end 90 of the base 86. The first connector rod 112 and the first channel 108 for receiving balls are positioned adjacent to opposite corners of the first end 88 of the base 86. The second connector rod 114 and the second channel 110 for receiving the balls are positioned adjacent to opposite corners of the second end 90 of the base 86.

The first connector rod 112 has a first end 116 and a second end 118. The second connector rod 114 has a first end (not shown) and a second end (not shown). The first and second connector rods 112 and 114 extend substantially perpendicular to the plane of the playing surface provided by the ball game table (not shown).

The first end 116 of the first connector rod 112 is positioned adjacent to one of the corners of the first end 88 of the base 86. The first end (not shown) of the second connector rod 114 is positioned adjacent to a corner at the second end 90 of the base 86 which is diagonally opposite to the first connector rod 112.

The second end 118 of the first connector rod 112 and the second end (not shown) of the second connector rod 114 each has a wheel 120 attached thereto. The wheel 120 is rotatable about an axis substantially perpendicular to a line joining the first 116 and second 118 ends of the connector rods 112 and 114.

The actuator comprises a first game selection mechanism 122 which engages the first connector rod 112. The actuator further comprises a second game selection mechanism 124 which engages the second connector rod 114.

The first and second game selection mechanisms 122 and 124 further comprise a wedge 126 adjacent to each of the first and second connector rods 122 and 124. The wedges 126 are each attached to a coin operated mechanism 128. The wedge 126 provides an upper surface 130 which extends at an angle to the plane of the playing surface provided by the ball game table (not shown). The lower surface 132 of the wedge 126 is substantially parallel to the playing surface of the ball game table (not shown).

The upper surface 130 of each of the wedges 126 is in contact with a wheel 120 of the first or second connector rods 112 and 114 respectively.

In use, before the user selects the game the ball separator is in a rest position. The magnetic members 98 and 100 cooperatively interact or engage to hold the base 86 in a substantially horizontal or level position, generally parallel to the horizontal plane of the playing surface provided by the ball game table when correctly levelled.

If the user selects to play the first game then they insert a coin into the coin operated mechanism 128 of the first game selection mechanism 122. The user slides the first game selection mechanism 122 from a first position in a direction 134 substantially parallel to the plane of the playing surface provided by the ball game table towards a second position. The game selection mechanism 128 is displaced towards the opposing surface of the ball game table.

As the first game selection mechanism 128 is displaced, the wheel 120 attached to the first connector rod 112 runs along the upper surface 130 of the wedge 126. As the wheel 120 runs along the upper surface 130 of the wedge 126 the first connector rod 112 is raised vertically relative to the playing surface of the ball game table. The first end 116 of the first connector rod 112 is brought into contact with a corner of the base 86 at the first end 88. The first connector rod 112 exerts sufficient force on the first end 88 of the base 86 to overcome the attraction between the first and second magnetic members 98 and 100.

As the wheel 120 of the first connector rod 112 runs along the upper surface 130 of the wedge 126 the first end 88 of the base 86 is progressively raised relative to the playing surface of the ball game table. The first connector rod 112 therefore causes the base 86 to tilt or pivot diagonally about the pivotable member 104 and the second end 12 of the base 8 lowers relative to the playing surface of the ball game table.

As the second end 90 of the base 86 lowers relative to the playing surface of the ball game table an opening 136 is exposed between the perimeter wall 80 and the second end 12 of the base 86. The opening 136 is exposed at the second end 90 of the base 86 at the corner opposite the second connector rod 114. The opening 136 allows balls to roll out of the housing 80 under gravity into the second channel 110. The balls roll along the second channel 110 into a first receptacle (not shown) from which the balls can be retrieved by the user.

The first game selection mechanism 120 is subsequently returned to the first position. The wedge 126 is moved in the opposite direction 136 substantially parallel to the plane of the playing surface provided by the ball game table. The first connector rod 112 is progressively lowered relative to the playing surface provided by the ball game table until the base 86 is held in a substantially horizontal position by the attraction between the magnetic members 98 and 100.

If the user then selects a second game using the second game selection mechanism 122 then a coin is placed in the coin selection mechanism 122. The user slides the second game selection mechanism 122 in the same manner as described above for the first game selection mechanism 120. The second game selection mechanism 122 operates in the same manner as described above for the first game selection mechanism and causes the base 86 to tilt or pivot about the axis of the pivotable member 104 in the opposite sense. The second end 90 of the base 86 is raised vertically relative to the playing surface provided by the ball game table. The first end 88 of the base 86 lowers and exposes an opening 36 between the perimeter wall 80 and the first end 88 of the base 86. The opening 36 allows balls to roll from the cavity provided by the housing 80 into the first channel 108 which dispenses the balls into a second receptacle (not shown) from which the balls can be retrieved by the user.

The invention claimed is:

1. A ball separator for separating balls of a first ball game from balls of a second ball game, in which the ball separator comprises:

a housing having an inlet for receiving the balls from the first and second ball games and guide surfaces which form a channel extending between a first outlet and a second outlet wherein the guide surfaces direct a received ball to the first outlet or to the second outlet, wherein the housing is movable between a first tilted position in which the first outlet is provided for dispensing balls under gravity to a first receptacle and a second tilted position in which the second outlet is provided for dispensing balls under gravity to a second receptacle; and an actuator for moving the housing between the first tilted position and the second tilted position.

2. The ball separator as claimed in claim 1 in which the housing includes a base which forms part of the channel.

3. The ball separator as claimed in claim 1 in which the channel has a first end and a second end, corresponding to the first outlet and second outlet respectively, and when the housing is in the first tilted position the first end of the base is lower relative to the second end of the base, and when the housing is in the second tilted position the second end of the base is lower relative to the first end of the base.

4. The ball separator as claimed in claim 1 in which the actuator can rotate the housing about a horizontal axis.

5. The ball separator as claimed in claim 1 further comprising: a playing surface on which a first and second ball game can be played.

6. The ball separator as claimed in claim 5 further comprising a game selection mechanism.

7. The ball separator as claimed in claim 5 in which the playing surface is a playing surface of a table on which a ball game can be played with a cue.

8. The ball separator as claimed in claim 7 in which the ball game is selected from the group comprising billiards, pool and snooker.

9. A method of providing an apparatus for playing at least a first ball game and a second ball game comprising the steps of:

manufacturing a ball game table having a first receptacle for storing balls of the first ball game and a second receptacle for storing balls of the second ball game; and providing the ball game table with a ball separator; for separating the balls of the first ball game from the balls of the second ball game, in which the ball separator comprises:

a housing having an inlet for receiving the balls from the first and second ball games and guide surfaces which form a channel extending between a first outlet and a second outlet wherein the guide surfaces direct a received ball to the first outlet or to the second outlet, wherein the housing is movable between a first tilted position in which the first outlet is provided for dispensing balls under gravity to a first receptacle and a second tilted position in which the second outlet is provided for dispensing balls under gravity to a second receptacle; and an actuator for moving the housing between the first tilted position and the second tilted position.

10. A method of retrofitting a ball separator to a ball game table, comprising the steps of: providing a ball game table having a first receptacle for playing a first ball game and a second receptacle for playing a second ball game;

providing the ball game table with a ball separator for separating balls of the first ball game from balls of the second ball game, in which the ball separator comprises:

a housing having an inlet for receiving the balls from the first and second ball games and guide surfaces which form a channel extending between a first outlet and a second outlet wherein the guide surfaces direct a received ball to the first outlet or to the second outlet, wherein the housing is movable between a first tilted position in which the first outlet is provided for dispensing balls under gravity to a first receptacle and a second tilted position in which the second outlet is provided for dispensing balls under gravity to a second receptacle; and an actuator for moving the housing between the first tilted position and the second tilted position.

* * * * *